US008387328B2

(12) United States Patent
Gentil

(10) Patent No.: US 8,387,328 B2
(45) Date of Patent: Mar. 5, 2013

(54) DEVICE FOR CONNECTING PREFABRICATED CONCRETE SECTIONS

(75) Inventor: Hugo Gentil, Marburg (DE)

(73) Assignee: Peikko Group Oy, Lahti (FI)

( * ) Notice: Subject to any disclaimer, the term of this patent is extended or adjusted under 35 U.S.C. 154(b) by 65 days.

(21) Appl. No.: 12/722,668

(22) Filed: Mar. 12, 2010

(65) Prior Publication Data

US 2010/0251656 A1 Oct. 7, 2010

(30) Foreign Application Priority Data

Mar. 12, 2009 (EP) ..... 09003587
Sep. 5, 2009 (EP) ..... 09011410

(51) Int. Cl.
*E04B 1/41* (2006.01)

(52) U.S. Cl. ..... 52/587.1; 52/584.1; 52/714; 52/122.1; 52/223.7; 403/291

(58) Field of Classification Search ..... 52/585.1, 52/714, 584.1, 587.1, 583.1, 122.1, 125.2, 52/125.3, 125.4, 125.5, 125.6, 704, 707, 52/223.7; 87/6, 7; 403/291, 269
See application file for complete search history.

(56) References Cited

U.S. PATENT DOCUMENTS 2,071,299 A * 2/1937 Gammeter ..... 404/49
2,167,098 A * 7/1939 Wells ..... 174/103
3,391,531 A * 7/1968 Riggs ..... 57/217
3,705,489 A * 12/1972 Smollinger ..... 57/214
3,758,704 A * 9/1973 Naud ..... 174/102 E
3,832,817 A * 9/1974 Martens ..... 52/583.1
4,111,401 A * 9/1978 Pickett ..... 256/13.1
4,150,906 A * 4/1979 Bernard ..... 403/213
4,290,246 A * 9/1981 Hilsey ..... 52/169.1
4,333,306 A * 6/1982 Yamashita et al. ..... 57/206
5,301,595 A * 4/1994 Kessie ..... 87/6
5,749,681 A * 5/1998 Doidge et al. ..... 405/302.2
5,799,457 A * 9/1998 Schumacher et al. ..... 52/405.3
6,102,607 A * 8/2000 Kintscher ..... 403/291
6,308,478 B1 * 10/2001 Kintscher et al. ..... 52/223.7
6,543,977 B2 * 4/2003 Sander et al. ..... 411/82.1
6,688,049 B2 * 2/2004 Sanftleben et al. ..... 52/125.4
6,779,950 B1 * 8/2004 Hutchins ..... 405/259.1
7,395,635 B2 * 7/2008 Neef et al. ..... 52/125.4
7,857,540 B2 * 12/2010 Ruel et al. ..... 403/208
8,091,317 B2 * 1/2012 Brackett ..... 52/742.14
2003/0140575 A1 * 7/2003 Sanftleben et al. ..... 52/125.4
2003/0140576 A1 * 7/2003 Sanftleben ..... 52/125.4
2005/0257445 A1 * 11/2005 Neef et al. ..... 52/125.2
2006/0204752 A1 * 9/2006 Frank ..... 428/364
2007/0062174 A1 * 3/2007 Clough et al. ..... 57/212
2008/0131200 A1 * 6/2008 Winkler et al. ..... 404/6
2009/0199493 A1 * 8/2009 Kintscher ..... 52/122.1

(Continued)

FOREIGN PATENT DOCUMENTS

DE 3322646 C2 7/1985
DE 10225699 B3 4/2004

(Continued)

*Primary Examiner* — Basil Katcheves
*Assistant Examiner* — Rodney Mintz
(74) *Attorney, Agent, or Firm* — Panitch Schwarze Belisario & Nadel LLP

(57) ABSTRACT

A device is provided for joining pre-cast concrete sections, the device including a cable loop, wherein the cable sections forming bent portions of the cable loop have elements for keeping the cable sections in a bent-over position, the elements are cable cores which lie within the cable sections of the cable loop and which are plastically deformable.

4 Claims, 2 Drawing Sheets

U.S. PATENT DOCUMENTS

2010/0229490 A1* 9/2010 Gentil ..... 52/585.1

FOREIGN PATENT DOCUMENTS

DE 20319471 U1 1/2005
DE 20 2007 011 243 U1 10/2007
EP 0534475 A1 3/1993
EP 0914531 B1 5/1999
EP 1637670 A1 3/2006
FR 1602226 A 10/1970

* cited by examiner

DEVICE FOR CONNECTING PREFABRICATED CONCRETE SECTIONS

BACKGROUND OF THE INVENTION

The present invention relates to a device for joining pre-cast (prefabricated) concrete sections, the device comprising a cable loop, wherein the cable sections forming the loop have means for keeping the cable sections in a bent-over position. The invention also relates to a pre-cast concrete section having a device of the kind described above.

A non-elastically deformable belt having an internally disposed core of stiff, deformable material, which is surrounded by a plurality of twisted strands, which in turn are surrounded by a casing, is known from French patent application publication FR-A-1602226.

Devices of the kind having a cable loop for joining pre-cast concrete sections, particularly prefabricated wall elements of concrete, are well-known from the prior art. Devices of this kind usually comprise a retaining part in the form of a rail, which is of U-shaped construction and which at the end is led into the pre-cast concrete section. It is necessary for transport and also during mounting of such a pre-cast concrete section that the cable loop substantially does not protrude beyond the edge face. To that extent it has to be achieved that the cable loop is received by the retaining part, i.e. substantially does not protrude beyond the retaining part.

In this connection, various devices are known from the prior art, which in principle do justice to this premise. Thus, for example, a receiving box is known from European patent application publication EP 1 637 670 A1, which has a removable cover, wherein the cable loop, which projects through an opening on the rear side of the receiving box, is held under stress against the removable cover by a spreading spring during transport and also during mounting. When the cover is removed, the cable loop shoots forward, not only due to the bias through the spreading spring but also due to the resilient characteristics of the cable loop, and goes over, for example in the case of an upright wall section, into an approximately horizontal position. That means the cable loop extends in the direction of the edge face of the opposite pre-cast concrete section.

The outlay which is necessitated in accordance with the prior art, in order to keep the cable loop during transport and mounting in a state bent over by approximately 90° and thus parallel to the upper side of the pre-cast concrete section, is high, and for that reason such devices are also very expensive.

Moreover, a device is known from European Patent EP 0 914 531 B1, which similarly comprises a U-shaped retaining part, which has on the rear side a passage opening for the cable loop, wherein the retaining part is of approximately U-shaped construction and wherein the limbs are bent over inwardly at the end. The cable loop now projects by its loop-shaped end through the opening, which is arranged on the rear side, in the retaining part and bears from within against the bent-over portions of the limbs of the retaining part. After mounting, the cable loop is pulled out of the retaining part by the loop-shaped end, whereby the cable loop snaps up.

German utility model DE 20 2007 011 243 U1 shows a similar construction insofar as a shaped part is provided there for fixing the cable loop, which shaped part has a mechanically positive couple with the section, which forms the bent-over cable eye, of the cable on at least three sides and which shaped part, after casting of the concrete pre-cast concrete section, may be withdrawn from the concrete pre-cast section and the cable eye.

In this connection, the outlay for keeping the cable loop in the bent-over state is relatively high, particularly because a specially constructed rail has to be produced as a retaining part, and in addition, the cable loop in the transfer to the pre-cast concrete section is kept by an insert body in the opening of the retaining part. This device is thus also comparatively expensive.

Finally, a device is known from European Patent EP 0 534 475 B1, in which an insert dish part is provided as well as a cover, wherein the insert dish part receives the cover by means of a snap connection. The loop-shaped end is kept parallel to the edge face of the pre-cast concrete section by the insert dish part in conjunction with the cover. It is also the case here that production of such a device is complicated and costly.

A cable transport anchor having a loop at the end is known from German published patent application DE 33 22 646 A1. The guiding together and bending over of central cable regions are carried out by a guiding and bending-over device which is formed by a sleeve.

BRIEF SUMMARY OF THE INVENTION

The object of the invention thus resides in producing a device of the kind stated in the introduction which is particularly economical to manufacture, but nevertheless reliably fulfils the same purpose as the prior art. In this connection reference is made to the following:

The cable loop projects, as already mentioned, by its loop-shaped end after mounting towards the edge face of the opposite pre-cast concrete section. The cable loop is disposed with its other end in the pre-cast concrete section. Once the cable loop is released, i.e. has been freed from its bent-over position, it is not necessary for the cable loop to be transferred back to this starting position, but it merely has to be ensured that during transport and during mounting the cable loop remains in the bent-over position.

Taking this into consideration the device according to the invention is distinguished by the fact that the means is a cable core which lies within the cable of the cable loop and which is plastically deformable. The cable core is thus, for example, an appropriately constructed metal wire, the stability of which is selected so that it is capable of keeping the cable loop in bent-over position. In order to bring the cable loop by its loop-shaped end into the unfolded position, merely a return bending process is required.

From this it is clear that the cable sections forming the loop are kept in their bent-over position by means which are in direct connection with the cable loop itself or are part of the cable loop. This is in complete contrast to the prior art, where in each instance a separate device is required in order to keep the cable loop in the bent-over position merely for transport and mounting. Since those separate devices are omitted, such a cable loop can be produced substantially more economically. In particular, to that extent the possibility also now exists of directly letting, or concreting in place, the cable loop in the edge face of a pre-cast concrete section, since—as already mentioned—separate devices for keeping the cable loop in a bent-over position during transport and during mounting are no longer required.

According to a further feature of the invention, provision is made for the cable loop to have an insert body, wherein the insert body has at least one opening for the cable loop and is insertable into a recess of the pre-cast concrete section. The insert body is, in particular, constructed to be of U-shaped profile in cross-section, wherein the web connecting the two limbs of the insert body of U-shaped profile has the opening for the cable loop. The cable loop projects with its closed end through this opening, whereby this end is also cast in place in the pre-cast concrete section. The cable loop lies with its bent-over loop-shaped end in the rail of U-shaped profile in cross-section.

The invention further includes a pre-cast concrete section, particularly a wall element of pre-cast concrete, which is distinguished by at least one device of the type described above. In detail, it is provided in this connection that the insert body is inserted at and edge of the pre-cast concrete section in such a manner that the front edge of the insert body is flush with the edge surface of the concrete section. It is clear from this that by having the insert body set back relative to the edge face, a denticulation with the casting mortar occurs during filling of the casting gap. The connection is thereby in a position to accept shearing forces. On the other hand, one or more reinforcing rods is or are pushed through the cable loops which overlap one another as a pair in such a manner that an eye results, whereby forces also acting in longitudinal direction of the cable loops can be accepted by the cable loops.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
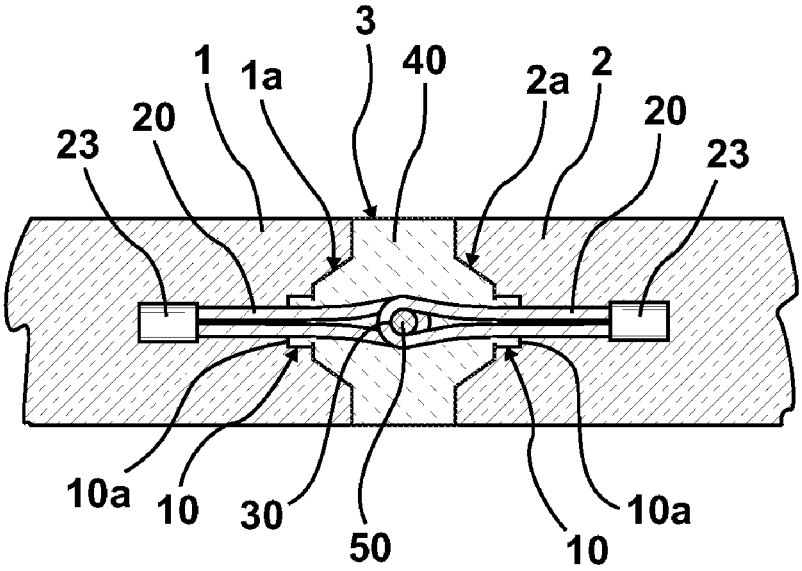
FIG. 1 is a schematic, end cross-sectional view showing edge portions of two pre-cast concrete sections which, spaced from one another, form a joint.

The two pre-cast concrete sections 1 and 2 according to FIG. 1 are disposed at a spacing from one another with formation of a joint 3. The pre-cast concrete sections 1 and 2 each have a trapezoid-shaped recess 1*a* or 2*a* at the edge face, wherein provided in the base of the trapezoid-shaped recess 1*a* is an insert body 10 which is recognizably constructed to be of U-shaped profile in cross-section. The insert body 10 is cast in place, with surface flushness, in the edge face of the respective wall section 1 or 2. The web 10*a* of the insert body of U-shaped profile has a passage opening 10*b* for the cable loop, which is designated overall by 20. The ends of the cable loop 20 are connected together by a pressed member 23, wherein this part of the cable loop is cast in place in the concrete of the pre-cast concrete section, just as is the insert body 10. The cable loop 20 overlaps the adjacent cable loop, wherein the eye 30 thereby formed receives a reinforcing rod 50. The joint 3 is then filled with casting mortar 40.

Figure 2:
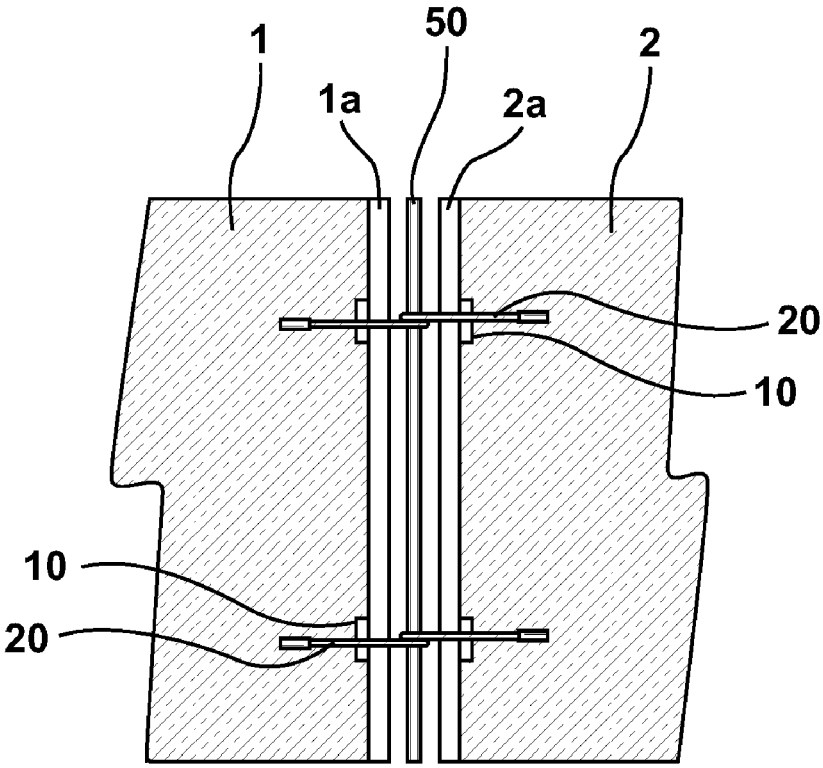
FIG. 2 is schematic, side cross-sectional view of the joint according to FIG. 1.

A side illustration of two pre-cast concrete sections connected together is evident from FIG. 2.

Figure 3:
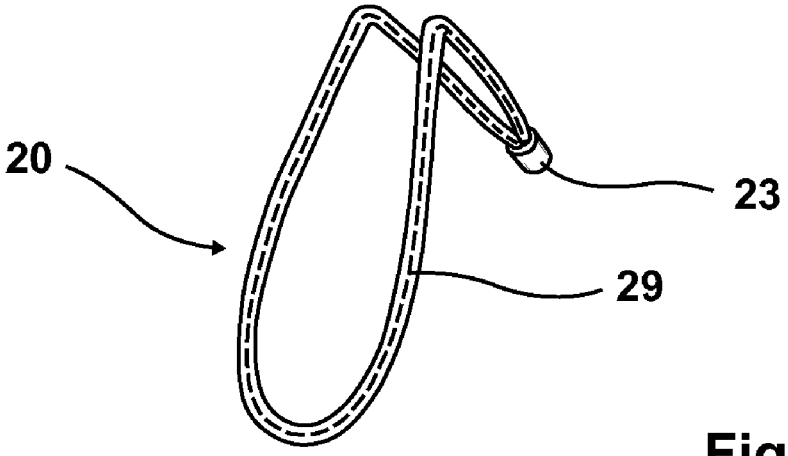
FIG. 3 is a perspective view of a cable loop according to an embodiment of the invention with the cable loop having a core of a metal wire.

The cable loop 20 in the bent-over state of the loop-shaped end is illustrated in FIG. 3. In this connection, the cable loop, which basically comprises a steel cable, has a core in the form of a wire 29, which is configured in such a manner that it is capable of keeping the wire cable, in the bent-over state, in this position.

Figure 4:
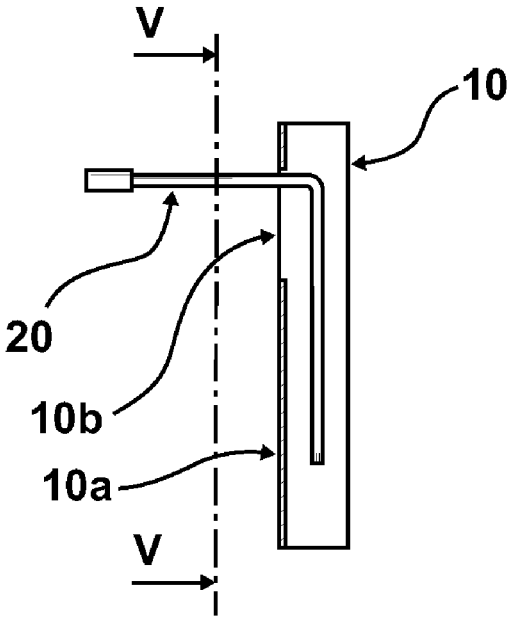
FIG. 4 is a side view of the cable loop according to FIG. 3 with an insert body.
Figure 5:
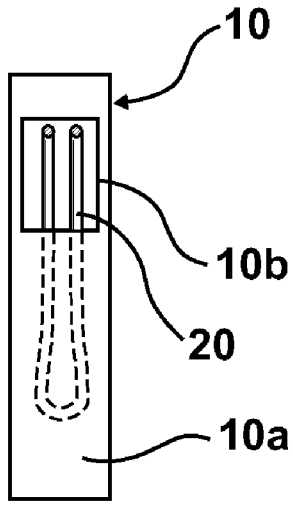
FIG. 5 is a view of the cable loop and insert body taken along the line V-V of FIG. 4.

The insert body 10 with a cable loop 20 in bent-over state is depicted in the illustration according to FIG. 4. The insert body 10, which is constructed to be of a U-shaped profile, has an opening 10*b* on its rear side (FIG. 5).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A device for joining pre-cast concrete sections, the device comprising:

a cable loop having cable sections which form bent portions of the cable loop, the cable loop comprising a steel cable;

an insert body insertable into a recess of a pre-cast concrete section, the insert body having a U-shaped profile and at least one opening for the cable loop, a portion of the cable loop which extends from the pre-cast concrete section lying in a channel of the U-shaped profile of the insert body in a bent-over position, and a plastically deformable element comprising a bendable wire, the entirety of the plastically deformable element lying within each of the cable sections of the cable loop, wherein the plastically deformable element retains the cable loop in the bent-over position in the channel of the U-shaped profile, and wherein the cable sections are to be retained in the bent-over position at least for a period after pre-casting in the pre-cast concrete section and during transportation and storage of the concrete section.

2. A pre-cast concrete section comprising a device according to claim 1, wherein the cable loop has a loop-shaped end, which for joining to another pre-cast concrete section projects towards an opposite edge face of the other pre-cast concrete section, and a pressed end embedded in an edge portion of the pre-cast concrete section.

3. The pre-cast concrete section according to claim 2, wherein the insert body is inserted into the recess of the pre-cast concrete section such that an open front edge of the U-shaped profile flush with a surface of an edge face of the pre-cast concrete section.

4. The pre-cast concrete section according to claim 2, wherein the concrete section is a wall element.

* * * * *